United States Patent [19]

Marks

[11] 4,130,277

[45] Dec. 19, 1978

[54] COMPOSITE PADDLE RIM

[75] Inventor: Nathan Marks, Garfield, N.J. N.J.

[73] Assignee: Marcraft Recreation Corp., Garfield, N.J.

[21] Appl. No.: 812,071

[22] Filed: Jul. 1, 1977

[51] Int. Cl.[2] ..... A63B 59/00

[52] U.S. Cl. ..... 273/67 R

[58] Field of Search ..... 273/9, 32 A, 67 R, 67 A, 273/67 D, 68, 70, 73 R, 73 C, 73 F, 76, 82 R, 82 B, 173, 174; 272/62, 63, 111

[56] References Cited

U.S. PATENT DOCUMENTS

| | | | |
|---|---|---|---|
| 1,710,341 | 4/1929 | Brochon | 273/70 |
| 1,886,721 | 11/1932 | O'Brien | 273/32 AX |
| 2,191,287 | 2/1940 | Perryman | 273/76 |
| 3,065,724 | 11/1962 | Tritt | 273/9 X |
| 3,106,401 | 10/1963 | Moran | 273/9 X |
| 3,300,250 | 1/1967 | Dollgener et al. | 273/9 X |
| 3,595,576 | 7/1971 | Gunia et al. | 273/70 |
| 3,610,618 | 10/1971 | Wiggins | 273/9 X |
| 3,879,250 | 4/1975 | Rankin | 273/67 R X |

*Primary Examiner*—Richard J. Apley

*Attorney, Agent, or Firm*—Blum, Moscovitz, Friedman & Kaplan

[57] ABSTRACT

A composite protective rim for protecting a game paddle and the participants utilizing the game paddle is provided. The protective rim is for a game paddle having a handle and a blade for surrounding at least a portion of the periphery of the blade. The protective rim is comprised of a metal element having a projection extending therefrom to effect anchoring of the metal element to the blade portion of the paddle and a resilient bumper bonded to the metal element along the lengthwise extent thereof.

7 Claims, 3 Drawing Figures

COMPOSITE PADDLE RIM

BACKGROUND OF THE INVENTION

This invention is directed to a composite paddle rim for a game paddle and, in particular, to a protective rim for protecting the periphery of the blade portion of a game paddle by securing a metal element and a resilient flexible bumper bonded thereto to the periphery of a paddle blade.

While game paddles for playing sports requiring close contact between the participants, such as paddle ball, platform tennis and the like, have taken on various forms, wooden paddles, wherein the blade portion is formed of a plurality of laminated layers having throughholes formed therein are preferred by most players due to the playability and sensitivity provided by the laminated wood layers. In order to protect the edges of the laminated layers from being particularly damaged by extended play, in particular, when the edges of the blade portion strike the walls or floor of the court upon which the game is played, protective metal rims have been provided in order to protect the end edge of the paddle from the rapid deterioration likely to be caused by continuous play.

Although such metal rims have been found to protect the periphery of the blade portion for a considerable length of time, a problem that often occurs in such paddles is that the metal rims, upon being struck, cause exposed edges to be formed, such edges often being particularly sharp and/or jagged. As an alternative to a rim formed entirely of metal, a resilient rim formed entirely of rubber or the like has been attempted, but such attempts have been less than completely satisfactory.

Specifically, a resilient protective rim, although not forming sharp and jagged edges during continued use, also is incapable of protecting the periphery of the paddle blade for a sufficient length of time when compared with the duration of time that protection is afforded by a metal rim. The short duration of time that protection is offered by a rubber rim is a result of the difficulties encountered in effecting a secure bond between rubber and wood. The inability to obtain a secure bond between the rubber and wood results in a rapid breaking up of the bond between the rubber protective layer and the wood surface during continuous play thereby rendering unsatisfactory the use or rubber protective layers on wood paddles to protect the peripheral surface of the paddle blade.

SUMMARY OF THE INVENTION

Generally speaking, in accordance with the instant invention, a composite paddle rim for a game paddle having a blade and handle extending from the blade is provided. The composite rim is adapted to surround at least a portion of the periphery of the blade and is comprised of an elongated metal element having at least one projection extending therefrom for anchoring the metal element to the blade of the paddle, and a resilient flexible bumper bonded to the metal element along the lengthwise extent thereof.

Accordingly, it is an object of the instant invention to provide an improved protective rim for a game paddle having a blade portion formed of wood.

A further object of the instant invention is to provide an improved protective rim for a game paddle comprised of metal and a suitable resilient bumper.

Still a further object of the instant invention is to provide a composite paddle rim for protecting the blade portion of the paddle over extended periods of use, and further protecting the players utilizing same.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
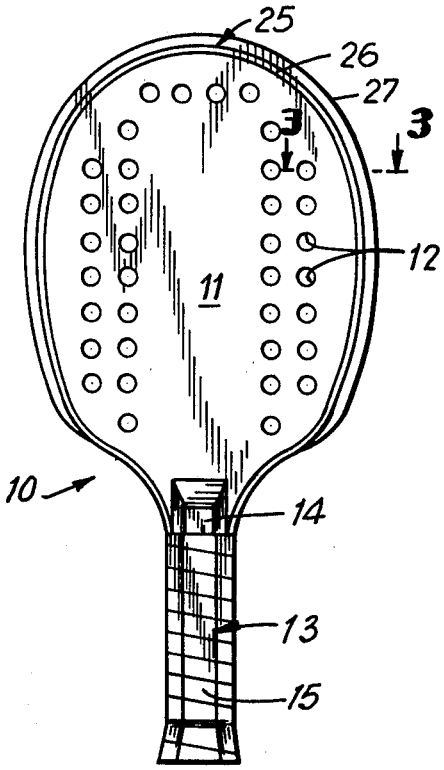
FIG. 1 is an elevational view of a game paddle constructed in accordance with the instant invention.
Figure 2:
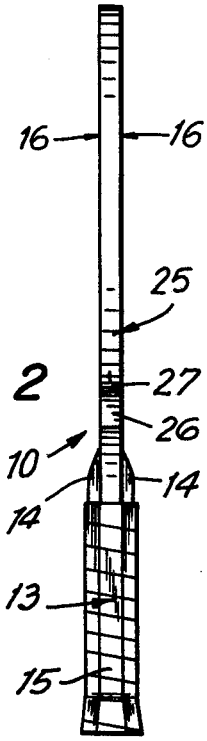
FIG. 2 is a side elevational view of a game paddle depicted in FIG. 1.
Figure 3:
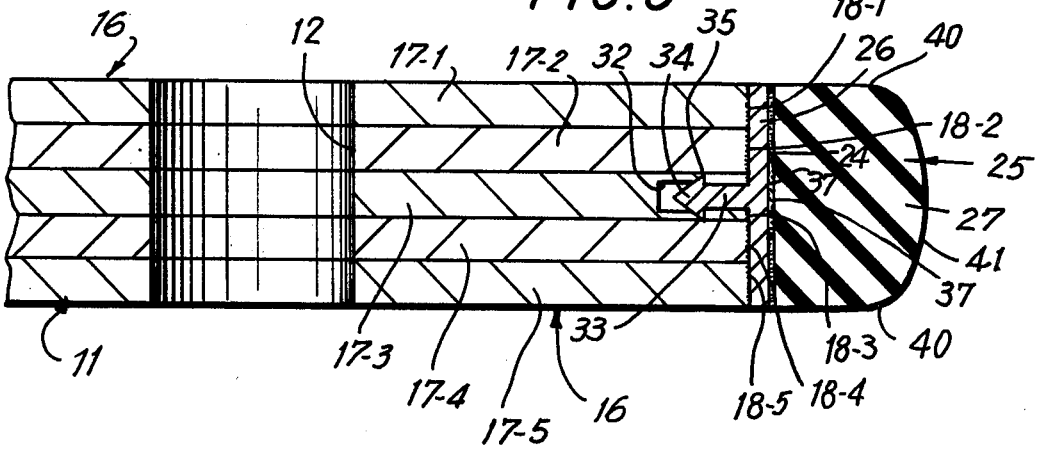
FIG. 3 is a sectional view taken along line 3—3 of FIG. 1.

Reference is now made to FIGS. 1 and 2, wherein a game paddle for paddle ball, platform tennis or the like, generally indicated at 10, is depicted. The game paddle 10 includes a blade portion 11 having a plurality of throughholes 12 formed therein, and a handle portion generally indicated as 13 extending from the blade portion. The handle portion 13 is conventional and can be formed of a one-piece elongated wood block for receiving a portion of the blade 11, and a leather grip 15 surrounding the block 14, the grip being formed by wrapping the block 14 with an elongated strip of leather in a conventional manner.

The blade portion 11 is formed of a plurality of laminated wood layers 17-1 through 17-5, which layers are laminated in a conventional manner to define opposed striking surfaces 16. Each of the laminated layers 17-1 through 17-5 has a surface edge, respectively illustrated as 18-1 through 18-5, that defines the periphery of the blade portion 11. As is detailed below, the instant invention is particularly characterized by a composite paddle rim formed of an elongated metal element and a resilient bumper formed of a suitable elastomer for protecting the peripheral edge of the blade portion 11, without providing an ultimate hazard to the game players as a result thereof.

A composite paddle rim, constructed in accordance with the instant invention, is generally indicated as 25 and is comprised of an elongated metal element 26 and an elongated urethane bumper 27. In an exemplary embodiment the elongated metal element is extruded. The middle laminated layer 17-3, of the blade portion, is formed with an elongated groove 32 extending around the periphery of the blade portion for receiving an anchoring projection 33 formed on the aluminum extrusion 26. Anchoring projection 33 includes a spear 34 having laterally disposed sharp barbs 35 for anchoring of the metal extrusion into the groove 32 formed in the middle laminated layer 17-3 of the blade portion. Accordingly, the metal extrusion is anchored to the blade portion by force fitting the anchoring projection 33 and spear 34, at the end thereof, into the elongated center groove 32, formed about the periphery of the blade portion. Moreover, the sharp laterally extending barbs 35 of the rim dig into the wood, and effect a secure anchoring of the metal extrusion of the blade portion of the paddle. Additionally, a suitable adhesive can be utilized to further secure the metal extrusion to the peripheral surface of the blade portion.

The urethane bumper 27 is cross-sectioned to form substantially flat side walls 40 and an arcuate end wall 41. Dimensioning the flate side walls 40, to define a cross-section substantially equal to the cross-section of the blade portion, will provide the largest possible area over which the rubber bumper can absorb shocks and thereby maximize the benefits to be obtained thereby. The urethane bumper 27 is bonded to the metal extrusion 26 at the same time that the urethane is cured to define what is referred to herein as a "curing-bond" of the urethane bumper 27 to the aluminum extrusion 26.

To effect a curing-bond of the urethane bumper to the metal extrusion, in accordance with a preferred embodiment of the instant invention, the aluminum extrusion is prepared by initially being degreased, sandblasted and thereafter coated with a primer, in a well known manner. Thereafter the bumper receiving surface of the metal extrusion 24 is coated with a suitable adhesive 31. It is noted that the adhesive can be of the curable type or of the drying solvent evaporation type. The urethane is, in an exemplary embodiment, a millable polyurethane of the polyester type, although a polyether type can also be utilized. A strip of millable urethane is then placed in abutting engagement with the surface 37 of the extrusion, having the adhesive layer 31 thereon, and is held in contact with the extrusion by suitable means so that the assembly can be heated to an appropriate level at a suitable pressure and held there for a sufficient period of time to effect curing of the urethane and, additionally, curing or solvent evaporation of the adhesive. It is noted that the simultaneous adhesive bonding, at the same time that curing is effected, results in a stronger bond between the metal element and urethane bumper than that obtainable if the bumper is first cured and then later adhesively secured to the metal element.

Accordingly, anchoring of the aluminum extrusion 26 to the blade portion in the manner detailed above, once a curing-bond of resilient urethane thereto has been affected, clearly provides the following benefits. The composite metal and gum rubber protective rim around the periphery of the blade portion provides protection to the edge of the blade portion for a longer period of time, provides a flexible resilient bumper that will protect a player from receiving the full impact of the blade portion when struck by same and, additionally, prevents a jagged edge or jagged point from being formed that could likely tear the skin of a player and cause severe damage thereto.

It is noted that the aluminum element described above need not be an extrusion and can be formed by die casting or other suitable forming methods. Also, other metals and metal alloys can be utilized instead of aluminum. Although the preferred elastomer utilizable for the bumper is urethane, a natural rubber compound can also be utilized. For example, if a natural rubber is utilized, the rubber can be simultaneously vulcanized in the same manner that the urethane is cured to obtain the same benefits noted above with respect to a curing-bond of urethane. Additionally, since the top half of the blade portion is more likely to strike the court surfaces, and hence be damaged, and also, since the uppermost half of the blade portion is also likely to strike another player, it is preferred that the composite paddle rim surround at least the top half of the paddle, when viewed in profile, but need not surround more than two-thirds of the length-wise extent of the blade portion.

Accordingly, three distinct benefits are provided by the composite paddle rim of the instant invention. By effecting a curing-bond of the resilient bumper to the metal extrusion, the resilient bumper can be securely adhered to the edge of the paddle and perform its intended funtion of protecting the other players during the life of the paddle. Secondly, the edge of the laminated layers, defining the wood blade portion, are protected during the useful life of the paddle by the metal extrusion. Finally, the resilient urethane bumper, in addition to offering protection to the other players, also affords protection to the metal extrusion, thereby preventing the metal extrusion from being otherwise damaged when the edge of the paddle blade strikes the court surfaces.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A composite protective rim in combination with a game paddle having a handle portion and a blade portion including opposed substantially planar surfaces, comprising rim means surrounding at least a portion of the periphery of said blade portion defined by said opposed planar surfaces, said rim means including an elongated metal element, said element having operative means projecting therefrom for anchoring said element to said blade portion of said paddle, said rim means further including a resilient bumper means bonded to said metal element along the lengthwise extent thereof.

2. A composite paddle rim as claimed in claim 1, wherein said resilient bumper means is formed of urethane and is adhered to said metal element by a curing-bond.

3. A composite paddle rim as claimed in claim 2, wherein said metal element is an aluminum extrusion.

4. A composite paddle rim as claimed in claim 1, wherein said operative means projecting from said metal element includes at least one elongated projection, said blade portion of said paddle including an elongated slot surrounding at least a portion of the periphery of said blade portion adapted to receive and secure said elongated projection in said groove.

5. A composite paddle rim as claimed in claim 4, wherein said elongated projection includes barbs disposed along the lengthwise extent thereof, said barbs being adapted to define an interference fit and thereby effect an anchoring of the elongated projection in said elongated slot.

6. A composite paddle rim as claimed in claim 5, wherein said blade portion is formed from a plurality of laminated layers of wood, and includes a plurality of throughholes formed therein.

7. A composite paddle rim as claimed in claim 1, wherein said metal element surrounds a portion of the periphery of the blade portion comprising at least the top half of said blade portion.

* * * * *